US009751708B2

(12) United States Patent
Hagihara et al.

(10) Patent No.: US 9,751,708 B2
(45) Date of Patent: Sep. 5, 2017

(54) SHEET TRANSPORT DEVICE AND IMAGE FORMING APPARATUS

(71) Applicant: FUJI XEROX CO., LTD., Tokyo (JP)

(72) Inventors: Junji Hagihara, Kanagawa (JP); Kiyoshi Watanabe, Kanagawa (JP); Toshitaka Tanaka, Kanagawa (JP); Yuta Chino, Kanagawa (JP); Tatsuya Yamashita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/922,734

(22) Filed: Oct. 26, 2015

(65) Prior Publication Data

US 2016/0297636 A1 Oct. 13, 2016

(30) Foreign Application Priority Data

Apr. 8, 2015 (JP) ..... 2015-079449

(51) Int. Cl.
*B65H 5/06* (2006.01)
*B65H 9/16* (2006.01)
*B65H 9/00* (2006.01)

(52) U.S. Cl.
CPC ..... *B65H 5/062* (2013.01); *B65H 5/064* (2013.01); *B65H 9/002* (2013.01); *B65H 9/166* (2013.01); *B65H 2301/331* (2013.01); *B65H 2404/1313* (2013.01); *B65H 2404/66* (2013.01)

(58) Field of Classification Search
CPC ..... B65H 2301/33; B65H 2301/331; B65H 9/06; B65H 9/14; B65H 9/166; B65H 9/004; B65H 2301/3412
USPC ..... 271/248, 234, 251
See application file for complete search history.

(56) References Cited

U.S. PATENT DOCUMENTS 1,754,955 A * 4/1930 Kruse ..... B26D 7/015 271/248
4,184,673 A * 1/1980 Weisbach ..... B65H 5/24 271/237
5,211,390 A * 5/1993 Igaki ..... B65H 5/00 271/250
5,657,983 A * 8/1997 Fisk ..... B65H 9/166 271/248
7,611,142 B2 * 11/2009 Kawashima ..... B65H 9/002 271/228

(Continued)

FOREIGN PATENT DOCUMENTS

JP 2008-030883 A 2/2008
JP 2008-273673 A 11/2008

*Primary Examiner* — Patrick Cicchino
(74) *Attorney, Agent, or Firm* — Oliff PLC

(57) ABSTRACT

A sheet transport device includes a transport path along which a sheet is transported in one direction, the sheet being transported with a corner at a leading end of the sheet being located on a first lateral side of the path, a sheet rotating section that rotates the sheet so as to increase an angle of the sheet and so as to orient the leading end, a sheet moving section that moves the sheet toward the first lateral side, and plural sheet butting portions that are arranged side-by-side in the one direction, on the first lateral side, the sheet butting portions allowing the moved sheet to be butted thereagainst to orient the sheet in the one direction. When the sheet is butted against the sheet butting portions to be oriented in the one direction, the corner is located at a position where no sheet butting portions are provided.

4 Claims, 7 Drawing Sheets

(56) References Cited

U.S. PATENT DOCUMENTS

| | | | | |
|---|---|---|---|---|
| 7,637,499 | B2 * | 12/2009 | Kawashima | B41J 13/103 271/238 |
| 8,328,177 | B2 * | 12/2012 | Claris | B65H 1/06 193/37 |
| 8,382,100 | B2 * | 2/2013 | Izawa | B65H 5/064 194/206 |
| 8,746,693 | B2 * | 6/2014 | Miyazawa | B65H 85/00 271/227 |
| 2002/0140802 | A1 * | 10/2002 | Yamada | G03B 27/32 347/262 |

* cited by examiner

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2015-079449 filed Apr. 8, 2015.

BACKGROUND

Technical Field

The present invention relates to a sheet transport device and an image forming apparatus.

SUMMARY

According to an aspect of the invention, there is provided a sheet transport device including a transport path along which a sheet is transported in one direction, the sheet being transported with a corner at a leading end of the sheet being located on a first lateral side of the transport path; a sheet rotating section that rotates the sheet on the transport path so as to increase an angle of the sheet relative to the one direction and so as to orient the leading end of the sheet toward a second lateral side of the transport path which is opposite to the first lateral side; a sheet moving section that moves the sheet rotated by the sheet rotating section toward the first lateral side of the transport path; and a plurality of sheet butting portions that are arranged side-by-side in the one direction, on the first lateral side of the transport path, the sheet butting portions allowing the sheet moved by the sheet moving section to be butted thereagainst to orient the sheet in the one direction. When the sheet is butted against the sheet butting portions to be oriented in the one direction, the corner at the leading end is located at a position where no sheet butting portions are provided.

BRIEF DESCRIPTION OF THE DRAWINGS

Exemplary embodiment of the present invention will be described in detail based on the following figures, wherein.

DETAILED DESCRIPTION

Referring to the attached drawings, an exemplary embodiment of the present invention will be described in detail below.

Figure 1:
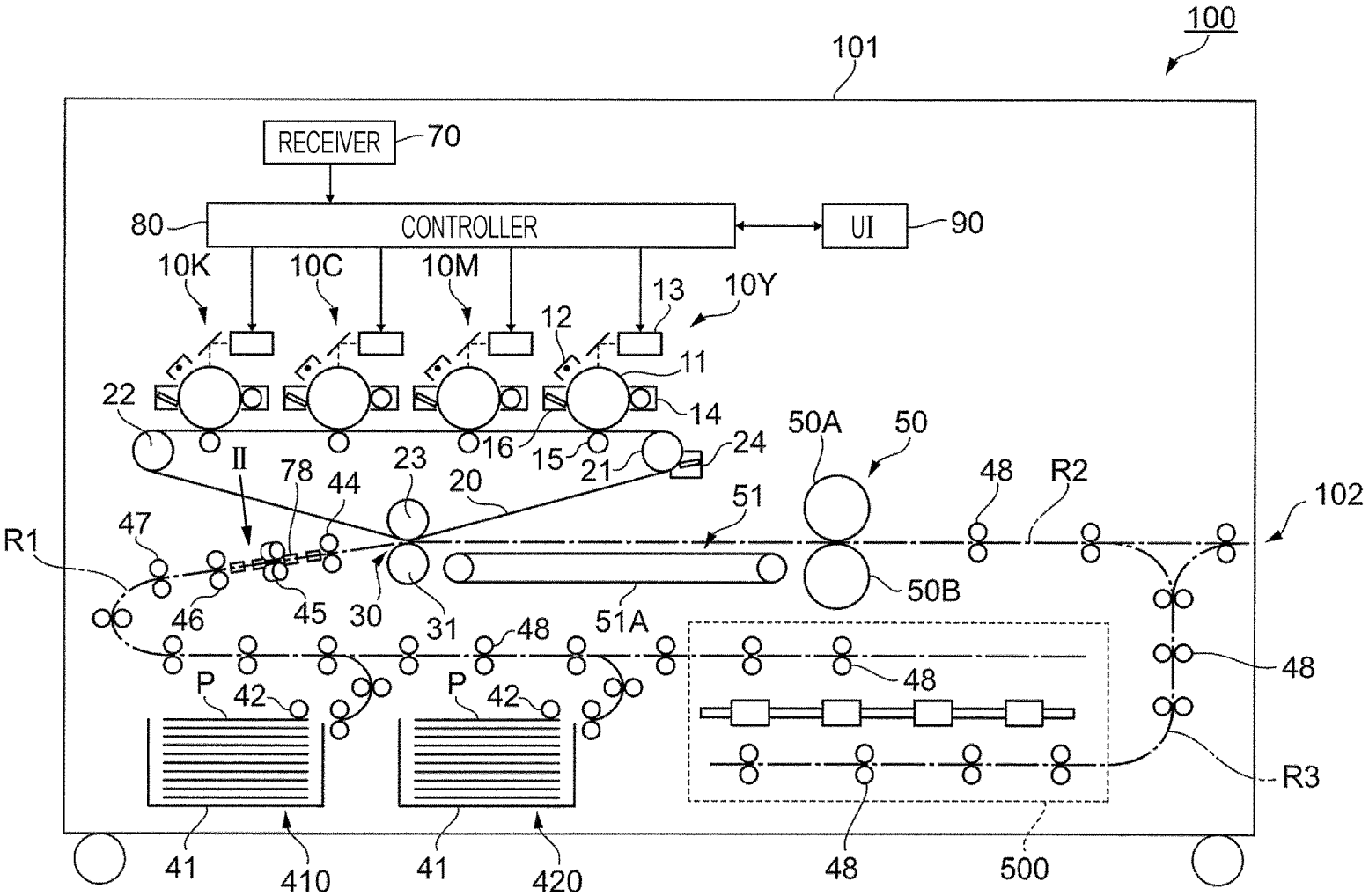
FIG. 1 shows an image forming apparatus according to an exemplary embodiment, as viewed from the front side.

FIG. 1 shows an image forming apparatus 100 according to an exemplary embodiment, as viewed from the front side.

The image forming apparatus 100 includes image forming units 10 (10Y, 10M, 10C, and 10K) that form color-component toner images by using an electrophotographic system.

The image forming apparatus 100 further includes a controller 80 that includes a central processing unit (CPU), a read-only memory (ROM), and the like and controls the operation of devices and portions that constitute the image forming apparatus 100.

The image forming apparatus 100 further includes a user interface portion (UI) 90. The UI 90 includes a display panel. The UI 90 outputs an instruction received from a user to the controller 80 and shows information from the controller 80 to the user.

The image forming apparatus 100 further includes an intermediate transfer belt 20 to which color-component toner images formed by the image forming units 10 are sequentially transferred (first transfer), and a second transfer device 30 that batch-transfers (second transfer) the toner images on the intermediate transfer belt 20 to a sheet P.

Herein, the image forming units 10, the intermediate transfer belt 20, and the second transfer device 30 may be regarded as an image forming section that forms an image on a sheet P.

The image forming apparatus 100 further includes a first sheet-transport path R1 along which a sheet P is transported toward the second transfer device 30, a second sheet-transport path R2 along which the sheet P is transported after passing through the second transfer device 30, and a third sheet-transport path R3 that is branched off the second sheet-transport path R2 and extends to a position below the first sheet-transport path R1.

Furthermore, a reversing mechanism 500 that transports the sheet P from the third sheet-transport path R3 to the first sheet-transport path R1 and reverses the sheet P is provided. Furthermore, a housing 101 of the image forming apparatus 100 has an opening 102.

The sheet P transported along the second sheet-transport path R2 is discharged to the outside of the housing 101 through the opening 102 and is stacked on a sheet stacking portion (not shown). A processing device (not shown) may be provided adjacent to the housing 101 for further processing, such as perforating the sheet P discharged from the opening 102.

Furthermore, a first sheet-feed device 410 and a second sheet-feed device 420 that feed sheets P to the first sheet-transport path R1 are provided.

The first sheet-feed device 410 and the second sheet-feed device 420 have the same configuration. The first sheet-feed device 410 and the second sheet-feed device 420 each have a sheet accommodating portion 41 that accommodates sheets P and a pick-up roller 42 that picks up and transports a sheet P accommodated in the sheet accommodating portion 41.

A first transport roller (registration roller) 44 that transports the sheet P on the first sheet-transport path R1 toward the second transfer device 30 is provided on the upstream side of the second transfer device 30.

The first transport roller 44 temporarily stops the sheet P and then transports the sheet P toward the second transfer device 30 at predetermined timing.

Furthermore, butting portions 78, against which a side edge of the sheet P transported along the first sheet-transport path R1 is butted, are provided on the upstream side of the first transport roller 44. The butting portions 78 are provided on one side (along one edge) of the first sheet-transport path R1.

Furthermore, second transport rollers (alignment rollers) 45 are provided in front of the butting portions 78 in FIG. 1 (i.e., in front of the butting portions 78, in the depth direction of the image forming apparatus 100).

The second transport rollers 45, serving as a sheet moving section and a sheet butting section, transport the sheet P downstream and move the sheet P toward the butting portions 78 to make a side edge of the sheet P butt against the butting portions 78.

Furthermore, a third transport roller (pre-alignment roller) 46 that transports the sheet P downstream and rotates (turns) the sheet P is provided on the upstream side of the second transport rollers 45.

A fourth transport roller 47 that transports the sheet P toward the third transport roller 46 is provided on the upstream side of the third transport roller 46.

The portion where the first transport roller 44 to the fourth transport roller 47 are provided has a function of transporting the sheet P, and thus, this portion may be regarded as a sheet transport device.

Note that, in this exemplary embodiment, in addition to these transport rollers, multiple transport rollers 48 are provided along the first sheet-transport path R1, the second sheet-transport path R2, and the third sheet-transport path R3 to transport the sheet P located on these sheet-transport paths.

A fixing device 50 that fixes the image second-transferred to the sheet P by the second transfer device 30 is provided on the second sheet-transport path R2.

Furthermore, a transport device 51 that transports the sheet P passing through the second transfer device 30 to the fixing device 50 is provided between the second transfer device 30 and the fixing device 50. The transport device 51 includes a revolving belt 51A that transports the sheet P placed thereon.

The fixing device 50 includes a heating roller 50A that is heated by a built-in heater (not shown) and a pressure roller 50B that presses the heating roller 50A.

In the fixing device 50, the sheet P is heated and pressed as it passes between the heating roller 50A and the pressure roller 50B. Thus, the image on the sheet P is fixed.

The image forming units 10 each include a rotatable photoconductor drum 11. A charging device 12 that charges the photoconductor drum 11, an exposure device 13 that exposes the photoconductor drum 11 to form an electrostatic latent image, and a developing device 14 that develops the electrostatic latent image on the photoconductor drum 11 into a visible image with toner are provided around the photoconductor drum 11.

In addition to the above, there are a first transfer device 15 that transfers a color-component toner image formed on the photoconductor drum 11 to the intermediate transfer belt 20, and a drum cleaning device 16 that removes residual toner from the photoconductor drum 11.

The intermediate transfer belt 20 is stretched over three rollers 21 to 23 so as to be able to revolve. Of these three rollers 21 to 23, the roller 22 drives the intermediate transfer belt 20. The roller 23 is disposed so as to oppose the second transfer roller 31 with the intermediate transfer belt 20 therebetween, and the second transfer roller 31 and the roller 23 form the second transfer device 30. A belt cleaning device 24, which removes residual toner on the intermediate transfer belt 20, is provided opposite the roller 21 with the intermediate transfer belt 20 therebetween.

The image forming apparatus 100 according to this exemplary embodiment is capable of forming an image not only on one side of a sheet P fed from the first sheet-feed device 410 or the like, but also on the other side thereof.

More specifically, in the image forming apparatus 100, a sheet P passing through the fixing device 50 is reversed by the reversing mechanism 500, and the reversed sheet P is transported again to the second transfer device 30, where an image is transferred to the other side of the sheet P. Then, the sheet P passes through the fixing device 50 again, where the transferred image is fixed to the sheet P. In this way, images are formed on both sides of the sheet P.

In the reversing mechanism 500, first, the sheet P on the third sheet-transport path R3 is moved toward, for example, the front side of the image forming apparatus 100, which is a direction perpendicular to the direction in which the third sheet-transport path R3 extends. This movement of the sheet P is performed by a transport roller (not shown) provided for this purpose.

At this time, the transport rollers 48 on the third sheet-transport path R3 (the transport rollers 48 provided in the reversing mechanism 500) are separated.

The sheet P moved in the direction perpendicular to the direction in which the third sheet-transport path R3 extends is directed upward by being guided by a guide member (not shown) having, for example, a substantially C shape in section. Furthermore, there are transport rollers (not shown) for transporting the sheet P upward, and the sheet P is transported further upward by these transport rollers.

Thereafter, the sheet P moves onto the first sheet-transport path R1 from a side of the first sheet-transport path R1. At this time, the transport rollers 48 on the first sheet-transport path R1 (the transport rollers 48 provided in the reversing mechanism 500) are separated.

Then, the sheet P is nipped by the transport rollers 48, and the transport rollers 48 are rotated. As a result, the reversed sheet P is transported toward the second transfer device 30.

Figure 2:
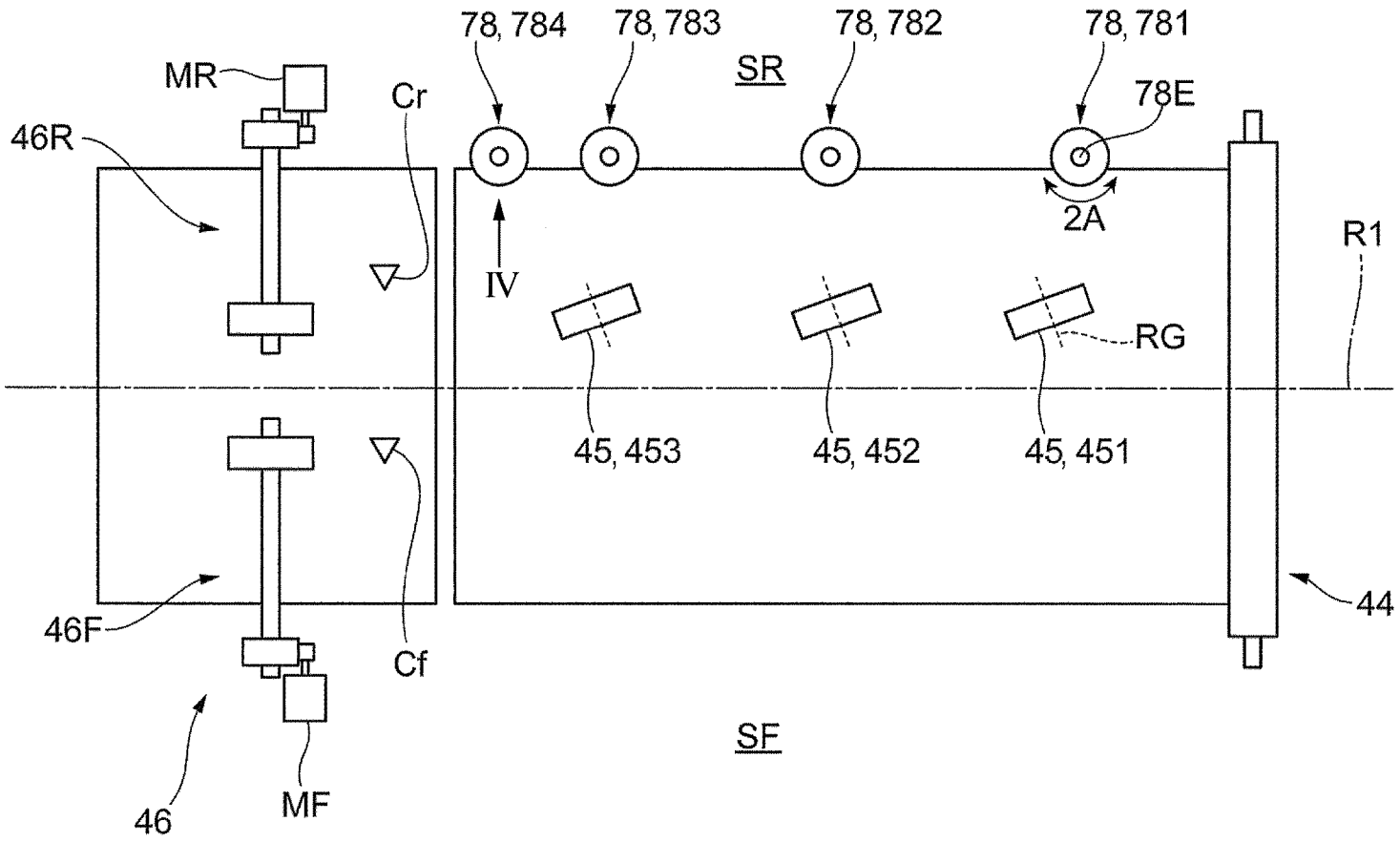
FIG. 2 shows a first sheet-transport path, as viewed from an arrow II direction in FIG. 1.

FIG. 2 shows the first sheet-transport path R1, as viewed from an arrow II direction in FIG. 1.

As shown in FIG. 2, and as has been described above, in this exemplary embodiment, the first transport roller (registration roller) 44 is provided. The first transport roller 44 transports a sheet P on the first sheet-transport path R1 toward the second transfer device 30 (see FIG. 1).

Furthermore, the butting portions 78, against which the side edge of the sheet P on the first sheet-transport path R1 is butted, are provided on one side SR (i.e., the rear side) of the first sheet-transport path R1.

There are multiple butting portions 78. The butting portions 78 are disposed side-by-side along the first sheet-transport path R1. Each of the butting portions 78 is formed of a rotary member that rotates about a cylindrical rotation shaft 78E, and is capable of rotation in the circumferential direction (i.e., the direction indicated by an arrow 2A).

In this exemplary embodiment, the sheet P moves downstream while being butted against the butting portions (a detailed description will be given below). At this time, because the butting portions 78 are rotatable, the sheet P moves more smoothly. The butting portions 78 are supported by support members (not shown).

The second transport rollers (alignment rollers) 45 are provided opposite the butting portions 78. The second transport rollers 45 transport the sheet P downstream, while transporting the sheet P toward the butting portions 78 (toward one side SR), making the side edge of the sheet P butt against the butting portions 78.

There are multiple (in this exemplary embodiment, three) second transport rollers 45.

The second transport rollers 45 are arranged at an angle. More specifically, rotation shafts RG of the second transport rollers 45 are arranged at an angle relative to the direction perpendicular to the direction in which the first sheet-transport path R1 extends.

The three second transport rollers 45 are located at positions shifted from one another in the sheet transport direction (i.e., in the left-right direction in FIG. 2).

Hence, one of the three second transport rollers 45 is located on the extreme downstream side. Another one is located immediately upstream of the second transport roller 45 located on the extreme downstream side, and the rest is located on the extreme upstream side.

Hereinbelow, the second transport roller 45 located on the extreme downstream side will be referred to as a downstream-side transport roller 451. Furthermore, the second transport roller 45 located immediately upstream of the downstream-side transport roller 451 will be referred to as an intermediate transport roller 452. Furthermore, the second transport roller 45 located on the extreme upstream side will be referred to as an upstream-side transport roller 453.

The relationship between the butting portions 78 and the downstream-side transport roller 451, the intermediate transport roller 452, and the upstream-side transport roller 453 will be described.

In this exemplary embodiment, one butting portion 78 is provided opposite the downstream-side transport roller 451. Hereinbelow, this butting portion 78 will be referred to as a first butting portion 781. Another butting portion 78 is provided opposite the intermediate transport roller 452. This butting portion 78 will be referred to as a second butting portion 782.

Two butting portions 78 are provided opposite the upstream-side transport roller 453. Of these butting portions 78, one located on the downstream side will be referred to as a third butting portion 783, and one located on the upstream side will be referred to as a fourth butting portion 784.

The third transport roller (pre-alignment roller) 46, serving as a sheet rotating section, includes a front-side roller 46F and a rear-side roller 46R.

The front-side roller 46F and the rear-side roller 46R are provided at positions shifted from each other in the direction perpendicular to (intersecting) the direction in which the sheet P moves (the left-right direction in FIG. 2).

Furthermore, in this exemplary embodiment, a front-side motor MF that rotationally drives the front-side roller 46F and a rear-side motor MR that rotationally drives the rear-side roller 46R are provided.

With this configuration, in this exemplary embodiment, the front-side roller 46F and the rear-side roller 46R are rotationally driven independently.

Furthermore, in this exemplary embodiment, two sensors, Cr and Cf, for detecting the leading end (leading edge) of the transported sheet P are provided between the second transport rollers 45 and the third transport roller 46. The sensor Cr is disposed on the rear side, and the sensor Cf is disposed on the front side.

Hereinbelow, the sensor Cr will be referred to as a rear sensor Cr, and the sensor Cf will be referred to as a front sensor Cf.

Figure 3:
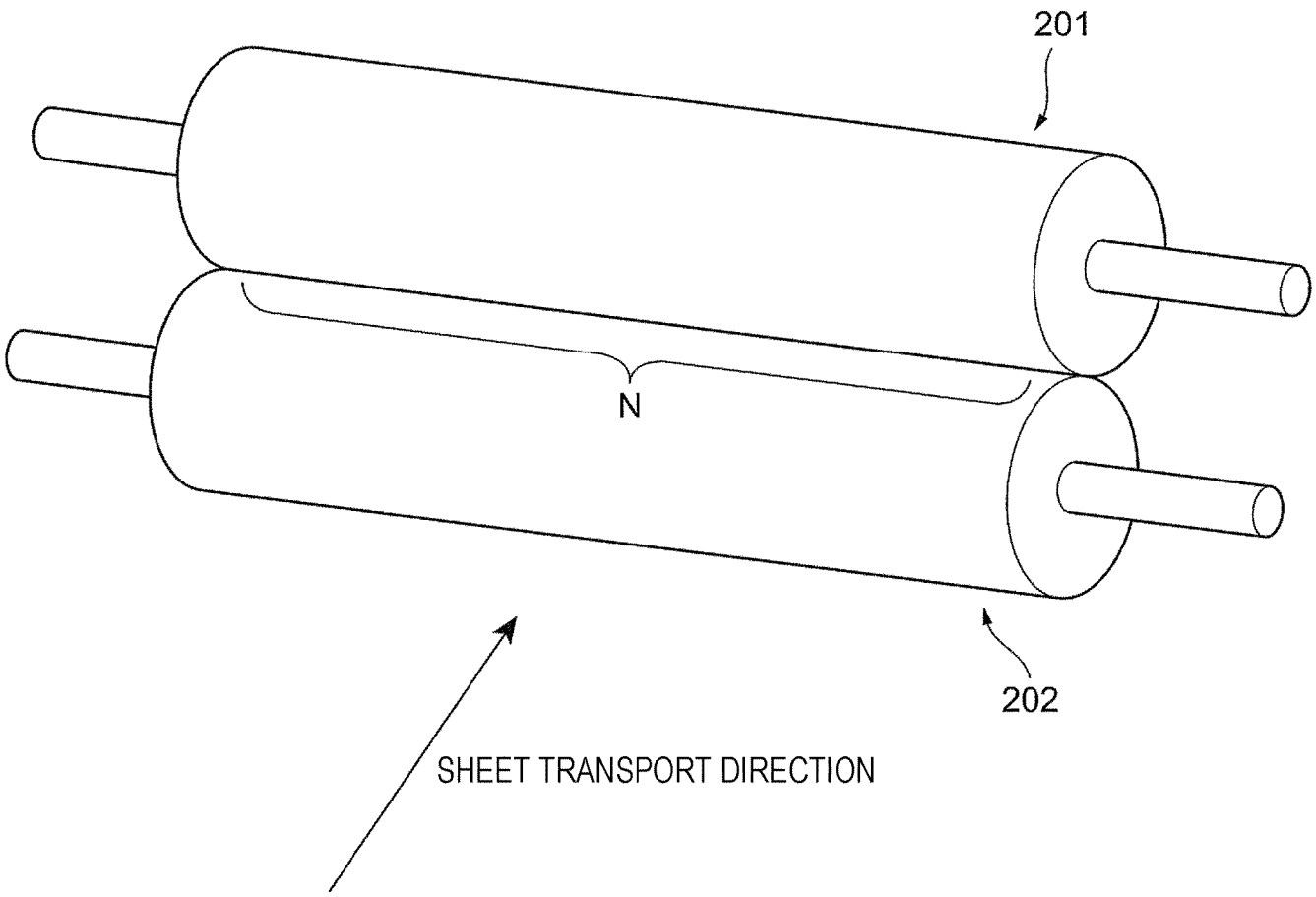
FIG. 3 shows transport rollers.

As shown in FIG. 3, which shows the configuration of the transport rollers, the first transport roller 44, the second transport rollers 45, the front-side roller 46F, the rear-side roller 46R, the fourth transport roller 47, and the transport rollers 48 each include a pair of rotary members 201 and 202.

In these transport rollers, one of the rotary members, 201, serves as a rotationally driving member, and the other rotary member, 202, serves as a driven member. Furthermore, a nip part N, which comes into contact with the sheet P and applies a transport force to the sheet P, is formed at a contact portion between the rotary member 201 and the rotary member 202. The nip part N extends in a direction perpendicular to the sheet transport direction.

Figure 4:
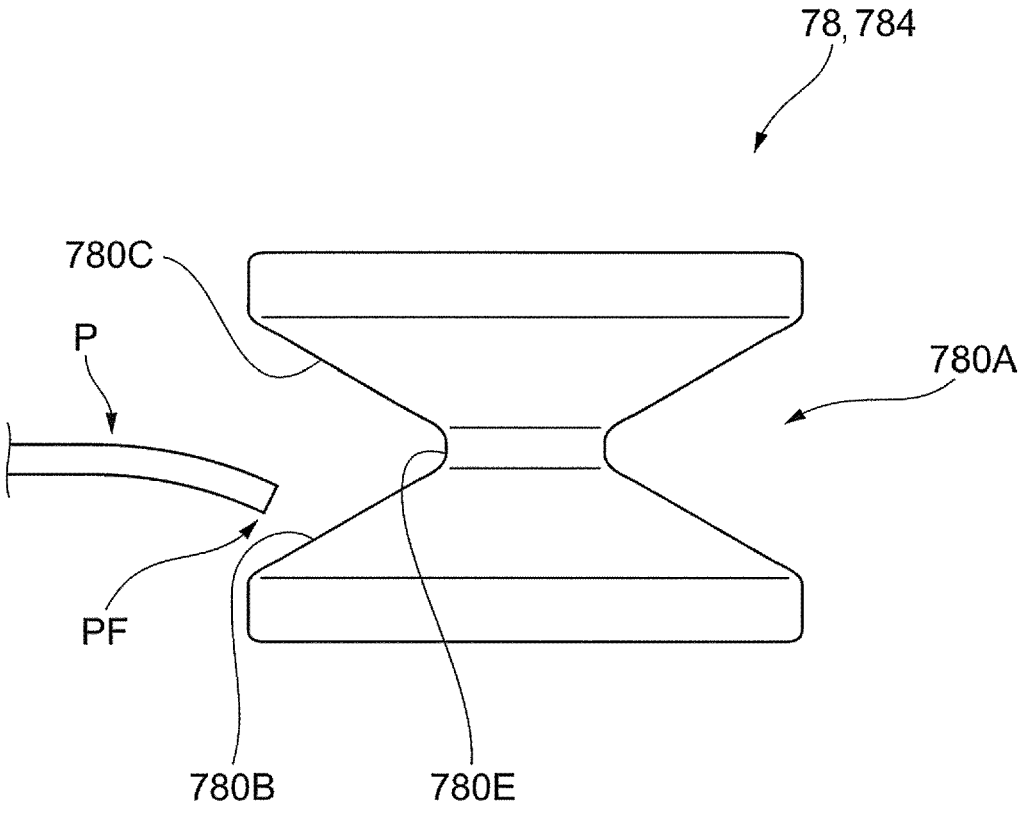
FIG. 4 shows a butting portion, as viewed from an arrow IV direction in FIG. 2.

FIG. 4 shows the butting portion 78 (the fourth butting portion 784), as viewed from an arrow IV direction in FIG. 2.

Each butting portion 78 is formed in a cylindrical shape. Furthermore, as shown in FIG. 4, the butting portion 78 has a depression 780A that is depressed inward relative to the outer circumferential surface of the butting portion 78. The depression 780A has a V-shaped section.

Thus, the butting portion 78 has a first sloped surface 780B extending between the lower surface thereof and a bottom 780E of the depression 780A and a second sloped surface 780C extending between the upper surface thereof and the bottom 780E of the depression 780A.

As shown in FIG. 4, a leading end PF of a sheet P may bend down during transportation. In such a case, in this exemplary embodiment, the leading end PF comes into contact with the first sloped surface 780B and is lifted up.

Figure 5:
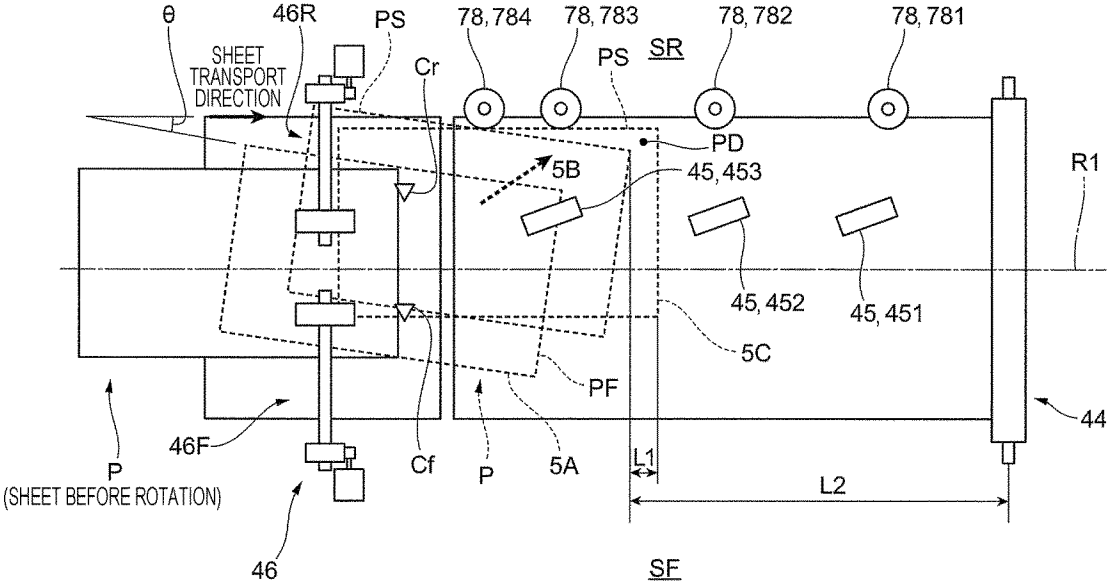
FIG. 5 shows the movement of a sheet on the first sheet-transport path.

FIG. 5 shows the movement of a sheet P on the first sheet-transport path R1.

When the sheet P is transported from the upstream side and reaches the third transport roller 46, serving as the sheet rotating section, the sheet P is rotated.

More specifically, as shown by reference sign 5A, the sheet P is rotated such that the leading end PF of the sheet P is oriented to the other side SF of the first sheet-transport path R1. More specifically, the sheet P is rotated such that the angle thereof relative to the direction in which the sheet P is transported (i.e., the direction in which the first sheet-transport path R1 extends; hereinbelow, the "sheet transport direction") (i.e., the skew angle) increases.

During transportation of the sheet P, the rotation speed Vr of the rear-side roller 46R is higher than the rotation speed Vf of the front-side roller 46F. Thus, the sheet P is rotated.

Next, in this exemplary embodiment, as shown by an arrow 5B, the sheet P is moved toward the butting portions 78 by the second transport roller 45 (upstream-side transport roller 453), and a side edge PS of the sheet P comes into contact with the fourth butting portion 784. Thereafter, the sheet P rotates in a counterclockwise direction about the portion in contact with the fourth butting portion 784. Thereafter, the sheet P comes into contact with the third butting portion 783, as shown by reference sign 5C.

As a result, the sheet P is oriented in the sheet transport direction, as shown by reference sign 5C.

In other words, the orientation of the sheet P is parallel to the direction in which the first sheet-transport path R1 extends, and the sheet P is not skewed. Hence, in this exemplary embodiment, a problem that an image formed on the sheet P is skewed relative to the side edge PS of the sheet P is less likely to occur.

In this exemplary embodiment, when the sheet P reaches the second transport roller 45 (upstream-side transport roller 453) and starts to be transported by the second transport roller 45, the rotary members 201 and 202 (see FIG. 3) of each of the front-side roller 46F and the rear-side roller 46R are separated.

This allows the sheet P to move easily, and the sheet P moves more smoothly toward the butting portions 78. The rotary members 201 and 202 are separated by an existing mechanism, such as a cam and a motor.

In this exemplary embodiment, because the sheet P is rotated as above, i.e., such that the leading end PF is oriented toward the other side SF, when the sheet P is butted against the butting portions 78, the trailing end of the sheet P is butted against the butting portions 78 before the leading end is.

As a result, in this exemplary embodiment, compared with a case where the leading end of the sheet P is butted against the butting portions 78 before the trailing end is, damage to the sheet P is less likely to occur.

Furthermore, in this exemplary embodiment, when the sheet P is rotated with the front-side roller 46F and the rear-side roller 46R, the sheet P is rotated such that the skew angle of the sheet P relative to the sheet transport direction is a predetermined skew angle θ.

More specifically, in this exemplary embodiment, first, the initial amount of skew of the sheet P is detected with the rear sensor Cr and the front sensor Cf. Based on the obtained amount of skew, the degree of rotation of the sheet P is determined, and the sheet P is rotated by the rear-side roller 46R and the front-side roller 46F, by the determined degree of rotation. By doing so, the skew angle of the sheet P after rotation, relative to the sheet transport direction, is made θ.

In this exemplary embodiment, when the skew angle is θ, a corner PD at the leading end (hereinbelow, leading end corner PD) is located between the second butting portion 782 and the third butting portion 783, as shown by reference sign 5C, when the sheet P becomes oriented in the sheet transport direction (i.e., when the sheet P extends parallel to the direction along which the sheet P is transported).

More specifically, when the sheet P that has been butted against the fourth butting portion 784 (the first butting portion 78 from the upstream side) and rotated is going to be butted against the third butting portion 783 (the second butting portion 78 from the upstream side), the leading end corner PD at one side SR is located on the downstream side of the third butting portion 783 and on the upstream side of the second butting portion 782.

Furthermore, in this exemplary embodiment, when the sheet P becomes oriented in the sheet transport direction, as shown by reference sign 5C, the leading end corner PD is located at a position where no butting portion 78 is provided.

Hence, in this exemplary embodiment, damage to the leading end corner PD due to the leading end corner PD being butted against the butting portions 78 is suppressed.

Furthermore, in this exemplary embodiment, when the sheet P becomes oriented in the sheet transport direction, two butting portions 78 (the third butting portion 783 and the fourth butting portion 784) are located on the upstream side of the leading end corner PD, as shown by reference sign 5C.

Thus, further rotation of the sheet P is restricted, and the leading end corner PD is prevented from entering between the second butting portion 782 and the third butting portion 783. Thus, the leading end corner PD is prevented from being butted against the second butting portion 782.

Herein, when the sheet P becomes oriented in the sheet transport direction, as shown by reference sign 5C, if there is only one butting portion 78 located on the upstream side of the leading end corner PD, that is, if the leading end corner PD is located between the third butting portion 783 and the fourth butting portion 784, and thus, there is only one butting portion 78 (the fourth butting portion 784) located on the upstream side of the leading end corner PD, the sheet P tends to be damaged.

If there is only one butting portion 78 located on the upstream side of the leading end corner PD (if only the fourth butting portion 784 is located on the upstream side of the leading end corner PD) when the sheet P becomes oriented in the sheet transport direction, the sheet P is rotated about this butting portion 78, making the leading end corner PD easy to enter between the third butting portion 783 and the fourth butting portion 784.

If the leading end corner PD enters between the third butting portion 783 and the fourth butting portion 784, the leading end corner PD comes into contact with the third butting portion 783 as the sheet P advances and may be damaged.

In contrast, as in this exemplary embodiment, if there are two butting portions 78 located on the upstream side of the leading end corner PD, the leading end corner PD is prevented from entering between the butting portions 78, and thus, damage to the leading end corner PD is less likely to occur.

In this way, in this exemplary embodiment, by making the sheet P have a skew angle of θ after rotation, damage to the sheet P is suppressed.

If the skew angle θ is increased, the distance of travel of the sheet P until the sheet P reaches the butting portions 78 increases. In such a case, the leading end corner PD may reach, for example, the second butting portion 782 or the first butting portion 781.

If the skew angle θ is reduced, the leading end of the sheet P tends to come into contact with the butting portions 78 before the trailing end of the sheet P does.

Desirably, the skew angle θ is changed according to the size of the sheet P. The size of the sheet P may be obtained from the information input by a user via the UI 90, or it may be obtained on the basis of the output from a size detection sensor that is provided in the first sheet-feed device 410 or the like.

Furthermore, different types of sheets P (e.g., normal paper, coated paper, etc.) have different frictional forces acting between the transport roller and the sheet P, even though the sheets P have the same size. Thus, the position where the sheet P reaches the butting portion 78 may vary depending on the sheet type.

Thus, the skew angle θ may be changed according to the sheet type. The sheet-type information may be obtained from, for example, the information input by the user via the UI 90.

Furthermore, in this exemplary embodiment, the sheet P reaches the first transport roller 44, serving as the transport section, after the sheet P becomes oriented in the sheet transport direction.

If the skew angle θ is large, the distance of travel of the sheet P until the sheet P reaches the butting portions 78 is large, and the sheet P that is still skewed may reach the first transport roller 44. Hence, in this exemplary embodiment, the skew angle θ is not increased more than required, thus preventing the skewed sheet P from reaching the first transport roller 44.

A more detailed description will be given by referring to FIG. 5. In this exemplary embodiment, the relationship $L1<L2$ is satisfied, where L1 is the distance of travel of the sheet P from when the sheet P starts to come into contact with the butting portions 78 to when it becomes oriented in the sheet transport direction, and L2 is the distance of travel of the sheet P from when the sheet P starts to come into contact with the butting portions 78 to when it reaches the first transport roller 44.

When this relationship is satisfied, the sheet P reaches the first transport roller 44 after it is oriented in the sheet transport direction.

Figure 6:
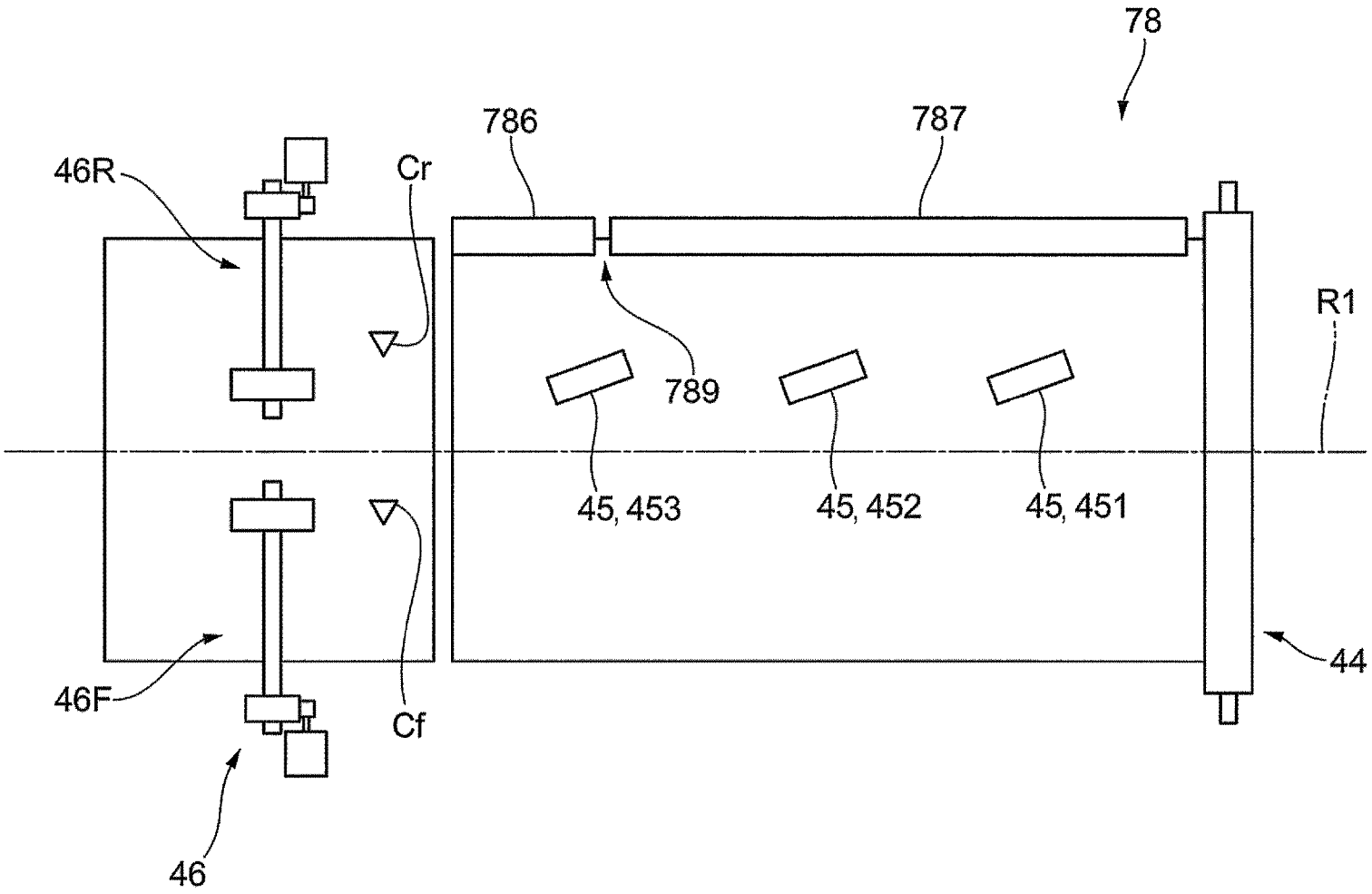
FIG. 6 shows another configuration example of the butting portion.

FIG. 6 shows another configuration example of the butting portion 78.

The butting portion 78 shown in FIG. 6 includes a first butting portion 786 and a second butting portion 787 that is located on the downstream side of the first butting portion 786.

The first butting portion 786 and the second butting portion 787 are formed in a plate shape and are provided along the first sheet-transport path R1.

The first butting portion 786 and the second butting portion 787 are disposed such that a gap is formed therebetween, and the gap serves as a depression 789 provided at a position where the sheet P is butted, in this exemplary embodiment.

Figure 7:
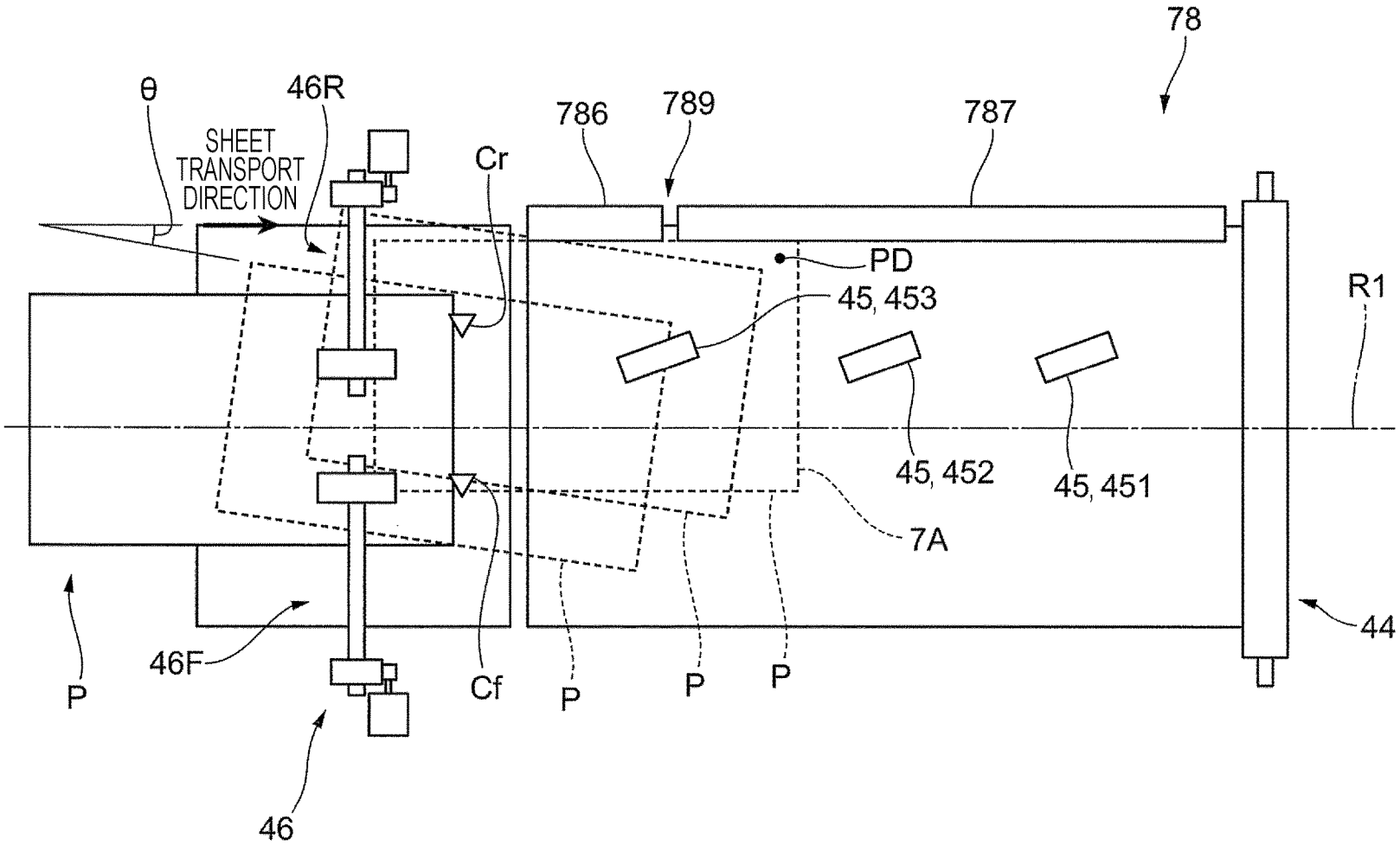
FIG. 7 shows the movement of a sheet.

FIG. 7 shows the movement of a sheet P.

In this configuration example, as shown by reference sign 7A in FIG. 7, when the sheet P becomes oriented in the sheet transport direction (when the leading end corner PD comes into contact with the sheet butting portion 78), the leading end corner PD is located at a position where the depression 789 is not provided. Thus, the leading end corner PD is prevented from entering the depression 789, and damage to the leading end corner PD is suppressed.

Furthermore, in this configuration example, when the sheet P becomes oriented in the sheet transport direction (when the leading end corner PD comes into contact with the sheet butting portion 78), the depression 789 is located on the upstream side of the leading end corner PD.

Thus, the leading end corner PD does not pass the depression 789, further reducing the risk of damaging the leading end corner PD.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device comprising:

a transport path along which a sheet is transported in one direction, the sheet being transported with a corner at a leading end of the sheet being located on a first lateral side of the transport path;

a controller configured to control a sheet rotating section so that:

the sheet rotating section rotates the sheet on the transport path so as to increase an angle of the sheet relative to the one direction to a predetermined angle and so as to orient the leading end of the sheet toward a second lateral side of the transport path which is opposite to the first lateral side;

when the sheet is butted against the sheet butting portions to be oriented in the one direction, the corner at the leading end is located at a position where no sheet butting portions are provided, and at the moment the sheet first becomes oriented in the one direction by butting against two or more butting portions of the plurality of sheet butting portions, the two or more sheet butting portions of the plurality of sheet butting portions are located on an upstream side of the corner at the leading end, a sheet moving section that moves the sheet rotated by the sheet rotating section toward the first lateral side of the transport path; and a plurality of sheet butting portions that are arranged side-by-side in the one direction, on the first lateral side of the transport path, the sheet butting portions allowing the sheet moved by the sheet moving section to be butted thereagainst to orient the sheet in the one direction.

2. The sheet transport device according to claim 1, wherein, when the sheet is oriented in the one direction, the corner at the leading end is located on a downstream side of a first sheet butting portion on an upstream side of a second sheet butting portion, the first sheet butting portion and the second sheet butting portion being included in the plurality of sheet butting portions and adjacent to each other in a transport direction of the sheet.

3. A sheet transport device comprising:

a transport path along which a sheet is transported in one direction;

a plurality of sheet butting portions that is disposed on a first lateral side of the transport path, the sheet butting portion allowing a side edge of the sheet on the transport path to be butted thereagainst to orient the sheet in the one direction;

a sheet rotating section that is disposed on an upstream side of the sheet butting portion;

a controller configured to control a sheet rotating section so that:

the sheet rotating section rotates the sheet on the transport path so as to increase an angle of the sheet relative to the one direction to a predetermined angle and so as to orient the leading end of the sheet toward a second lateral side of the transport path which is opposite to the first lateral side;

at the moment the sheet first becomes oriented in the one direction by butting against two or more sheet butting portions of the plurality sheet butting portions, the two or more sheet butting portions of the plurality of sheet butting portions are located on an upstream side of the corner at the leading end;

a sheet butting section that moves the sheet rotated by the sheet rotating section toward the first lateral side of the transport path to cause a side edge of the sheet to be butted against the sheet butting portion; and a transport section that is located on a downstream side of the sheet butting section and transports the sheet further downstream, wherein the sheet reaches the transport section after being butted against the sheet butting portion and oriented in the one direction.

4. An image forming apparatus comprising:

a sheet transport device that transports a sheet; and an image forming section that forms an image on the sheet transported by the sheet transport device, wherein the sheet transport device is the sheet transport device according to claim 1.

* * * * *